US010284958B2

(12) United States Patent
Liu et al.

(10) Patent No.: US 10,284,958 B2
(45) Date of Patent: May 7, 2019

(54) SILICA GEL DIAPHRAGM, SPEAKER MODULE, AND METHOD FOR REPROCESSING SILICA GEL DIAPHRAGM

(71) Applicant: GOERTEK INC., Weifang (CN)

(72) Inventors: Chunfa Liu, Weifang (CN); Xiaodong Guo, Weifang (CN)

(73) Assignee: GOERTEK INC., Shandong (CN)

( * ) Notice: Subject to any disclaimer, the term of this patent is extended or adjusted under 35 U.S.C. 154(b) by 0 days.

(21) Appl. No.: 15/552,051

(22) PCT Filed: Dec. 18, 2015

(86) PCT No.: PCT/CN2015/097964
§ 371 (c)(1),
(2) Date: Aug. 18, 2017

(87) PCT Pub. No.: WO2016/169284
PCT Pub. Date: Oct. 27, 2016

(65) Prior Publication Data

US 2018/0077495 A1 Mar. 15, 2018

(30) Foreign Application Priority Data

Apr. 23, 2015 (CN) ..... 2015 1 0204166

(51) Int. Cl.
*H04R 1/06* (2006.01)
*H04R 7/04* (2006.01)
(Continued)

(52) U.S. Cl.
CPC ..... *H04R 7/16* (2013.01); *H04R 1/06* (2013.01); *H04R 7/04* (2013.01); *H04R 9/02* (2013.01); *H04R 31/00* (2013.01); *H04R 31/003* (2013.01)

(58) Field of Classification Search
CPC ..... H04R 7/16; H04R 31/003; H04R 7/02
See application file for complete search history.

(56) References Cited

U.S. PATENT DOCUMENTS

2004/0008862 A1* 1/2004 Garner ..... B60R 11/0223 381/423
2009/0268928 A1* 10/2009 Ikeyama ..... C09J 7/25 381/150

FOREIGN PATENT DOCUMENTS

CN 103024638 A * 4/2013 ..... H04R 9/06
CN 103281661 A 9/2013
(Continued)

OTHER PUBLICATIONS

International Search Report (PCT/ISA/210) dated Feb. 2, 2016, by the Chinese Patent Office as the International Searching Authority for International Application No. PCT/CN2015/097964.
(Continued)

*Primary Examiner* — Sunita Joshi
(74) *Attorney, Agent, or Firm* — Buchanan Ingersoll & Rooney PC

(57) ABSTRACT

A silica gel diaphragm, a speaker module, and a method for reprocessing a silica gel diaphragm. Two symmetrical wire grooves are etched on a surface of the silica gel diaphragm by laser etching technique, an electrically conductive metal layer is deposited in each of the grooves, and either end of each of the metal layers includes a first and second soldering portions. Each of the first soldering portions is deposited on a planar portion of the silica gel diaphragm, and is used for soldering a winding tap of a voice coil on an inner side of the voice coil. Each of the second soldering portions is deposited on a fixing portion of the silica gel diaphragm, and is used for soldering a bonding pad on a housing. Middle portions connecting the first soldering portions and the second soldering portions are deposited in the diaphragm to form an electrically conductive path.

9 Claims, 3 Drawing Sheets

(51) Int. Cl.

| | |
|---|---|
| ***H04R 7/16*** | (2006.01) |
| ***H04R 9/02*** | (2006.01) |
| ***H04R 31/00*** | (2006.01) |

(56) References Cited

FOREIGN PATENT DOCUMENTS

| | | | |
|---|---|---|---|
| CN | 104853294 | A | 8/2015 |
| JP | 2003-199193 | A | 7/2003 |

OTHER PUBLICATIONS

Written Opinion (PCT/ISA/237) dated Feb. 2, 2016, by the Chinese Patent Office as the International Searching Authority for International Application No. PCT/CN2015/097964.
Office Action dated May 12, 2017, by the Chinese Patent Office for Application No. 201510204166.X.

* cited by examiner

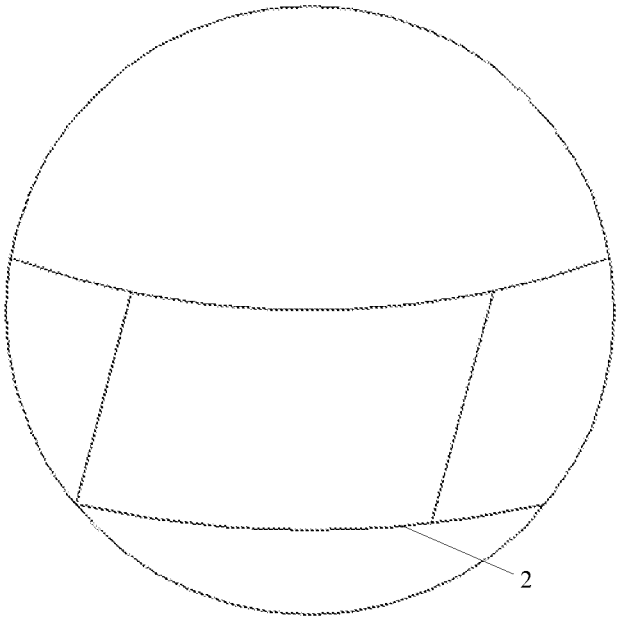
Fig. 3-a
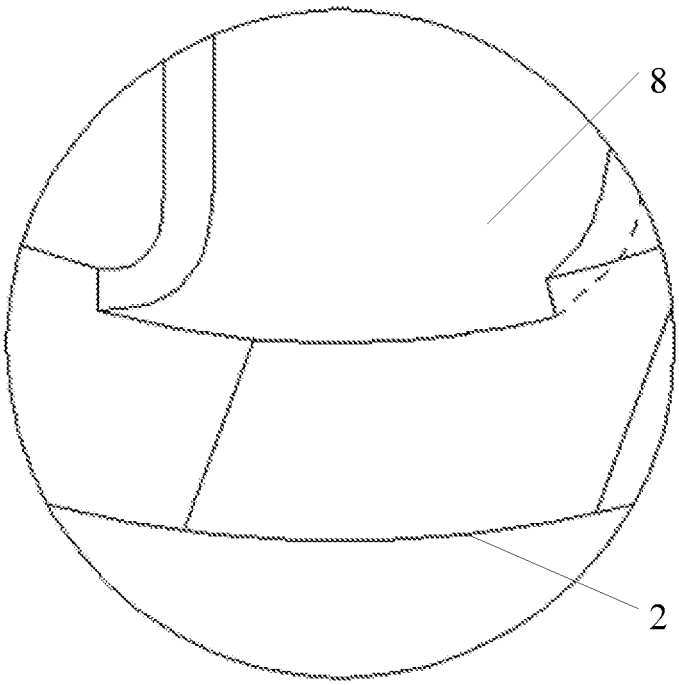
Fig. 3-b

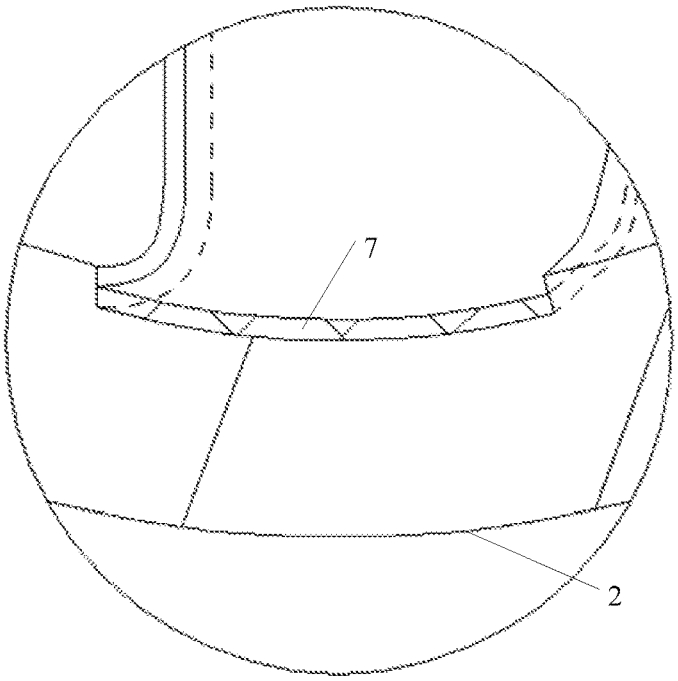
Fig. 3-c
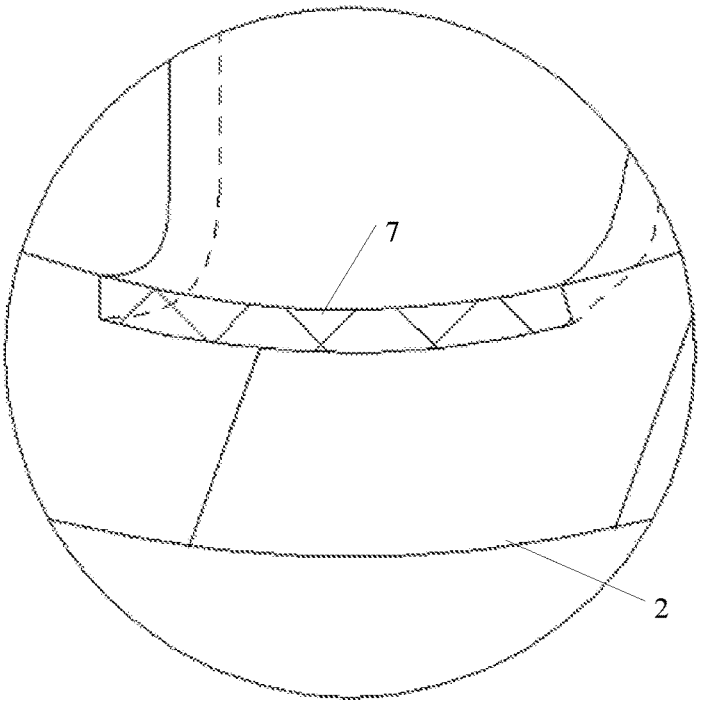
Fig. 3-d

SILICA GEL DIAPHRAGM, SPEAKER MODULE, AND METHOD FOR REPROCESSING SILICA GEL DIAPHRAGM

CROSS REFERENCE TO RELATED APPLICATIONS

This application is a national phase of International Application No. PCT/CN2015/097964, filed on Dec. 18, 2015, which is based upon and claims priority to Chinese Patent Application No. 201510204166.X, filed on Apr. 23, 2015, the entire contents of each of which are incorporated herein by reference.

TECHNICAL FIELD

The present disclosure relates to the technical field of electroacoustic products, and in particular, to a silica gel diaphragm, a speaker module and a method for reprocessing a silica gel diaphragm.

BACKGROUND

The vibration voice coils of traditional moving-coil speakers comprise a voice coil body and voice coil lead wires. The voice coil lead wires usually appear in two forms. One is that the voice coil lead wires are attached to the diaphragm, but this method will easily cause the unbalance of the vibration system and the polarization of the diaphragm. The other is that the voice coil lead wires are suspended between the diaphragm and the housing, but this method has very strict requirements on the radian and height of the voice coil lead wires, as well as the symmetry of the negative and positive lead wires; otherwise the voice coil lead wires will easily touch the housing or the diaphragm to cause poor acoustics. In both methods, when the speaker works in a high power mode for a long time, the vibration voice coil and the voice coil lead wires are bent repetitively, and thus there is a potential risk that the voice coil lead wires might be broken, and the product stability is poor.

In addition, the industry has solutions that form a conductive layer using techniques such as electroplating or magnetron sputtering to replace the lead wires of the vibration voice coil. However, the metal particles in the conductive layer formed by the electroplating or magnetron sputtering are arranged sparsely, which causes the defects that the resistance of the conductive layer is too high, and the conductive layer will easily drop off.

SUMMARY

In view of the above problems, the present disclosure is proposed to provide a silica gel diaphragm, a speaker module, and a method for reprocessing a silica gel diaphragm, which can overcome or at least partially solve the above problems. The technical solutions of the present disclosure are implemented as follows:

In one aspect, the present disclosure provides a silica gel diaphragm, comprising a planar portion located at a center, a folded ring portion disposed at an edge of the planar portion, and a fixing portion connected to the periphery of the folded ring portion for bonding a housing, wherein two symmetrical wire grooves are etched on a surface of the silica gel diaphragm by laser etching technique; and an electrically conductive metal layer is deposited in each of the wire grooves, and either end of each of the electrically conductive metal layers is provided with a first soldering portion and a second soldering portion; each of the first soldering portions is deposited on a planar portion of the silica gel diaphragm that is closer to the folded ring portion, and is used for soldering a winding tap of a voice coil on an inner side of the voice coil; each of the second soldering portions is deposited on a fixing portion of the silica gel diaphragm, and is used for soldering a bonding pad on the housing; and middle portions connecting the first soldering portions and the second soldering portions are deposited in the silica gel diaphragm to form an electrically conductive path.

Preferably, upper surfaces of the two electrically conductive metal layers are lower than or flush with the surface of the silica gel diaphragm.

Preferably, the first soldering portions of the two electrically conductive metal layers are symmetrically deposited at central positions on the planar portion that are closer to the folded ring portion.

The technical solution etches two symmetrical wire grooves on the surface of the silica gel diaphragm, and an electrically conductive metal layer is deposited in each of the wire grooves, such that the soldering portions at the two ends of each of the electrically conductive metal layers can be soldered with the voice coil and the bonding pad, respectively, thereby achieving the connection between the voice coil and the bonding pad by using the electrically conductive metal layer. By using the solution of replacing the voice coil lead wires with the two electrically conductive metal layers deposited on the silica gel diaphragm, firstly, the problem of the poor audition caused by the collision of the voice coil lead wires in traditional solutions can be solved, and the acoustic performance of the product can be improved; secondly, the electrically conductive metal layer deposited in the wire groove does not occupy extra space, and avoids the risk of the breakage of the voice coil lead wires vibrated under a large power, so as to improve the product stability; and thirdly, since the electrically conductive metal layer is deposited in the etched wire groove, the conductive layer will not easily drop off and becomes more stable, and compared with techniques such as electroplating or magnetron sputtering, the electrically conductive metal layer obtained via metal deposition is more dense and uniform with a higher conductivity, and any crack will not easily occur.

In another aspect, the present disclosure further provides a speaker module, comprising a vibration system received in a housing, wherein the vibration system comprises a diaphragm and a voice coil combined together, wherein the diaphragm is the silica gel diaphragm provided in the above technical solution; and the voice coil is fixed on an inner side of the folded ring portion of the silica gel diaphragm; first soldering portions of two electrically conductive metal layers of the silica gel diaphragm are soldered with winding taps at two ends of the voice coil, respectively; and second soldering portions of the two electrically conductive metal layers are soldered with two bonding pads on the housing, respectively.

In the speaker module of the embodiment, two electrically conductive metal layers deposited in the silica gel diaphragm are used to replace the voice coil lead wires in traditional solutions, such that the first soldering portions of the two electrically conductive metal layers are soldered with the winding taps on the inner side of the voice coil, and the second soldering portions are soldered with the bonding pads on the housing, thereby solving the problem of the poor audition caused by the collision between the voice coil lead wires and the diaphragm or the housing, improving the acoustic performance of the module, avoiding the risk of the breakage of the voice coil lead wires vibrated under a large power, and increasing the stability of the speaker module.

In still another aspect, the present disclosure provides a method for reprocessing a silica gel diaphragm, the silica gel diaphragm comprising a planar portion located at a center, a folded ring portion disposed at an edge of the planar portion, and a fixing portion connected to the periphery of the folded ring portion for bonding a housing, wherein the method comprises:

etching two symmetrical wire grooves on a surface of the silica gel diaphragm by laser etching technique; and depositing a metal conductive material in the two symmetrical wire grooves to obtain two electrically conductive metal layers;

wherein either end of each of the electrically conductive metal layers is deposited with a first soldering portion and a second soldering portion; each of the first soldering portions is deposited on a planar portion of the silica gel diaphragm that is closer to the folded ring portion, and is used for soldering a winding tap of a voice coil on an inner side of the voice coil; each of the second soldering portions is deposited on a fixing portion of the silica gel diaphragm, and is used for soldering a bonding pad on the housing; and middle portions connecting the first soldering portions and the second soldering portions are deposited in the silica gel diaphragm to form an electrically conductive path.

Preferably, the depositing a metal conductive material in the two symmetrical wire grooves to obtain two electrically conductive metal layers comprises:

upper surfaces of the two electrically conductive metal layers are lower than or flush with the surface of the silica gel diaphragm.

Preferably, that each of the first soldering portions is deposited on a planar portion of the silica gel diaphragm that is closer to the folded ring portion comprises:

the first soldering portions of the two electrically conductive metal layers are symmetrically deposited at central positions on the planar portion that are closer to the folded ring portion.

The technical solution etches two symmetrical wire grooves on the surface of the silica gel diaphragm by laser etching technique, and deposits an electrically conductive metal layer in each of the wire grooves by metal deposition technique, such that the soldering portions at the two ends of each of the electrically conductive metal layers can be soldered with the voice coil and the bonding pad, respectively, thereby achieving the connection between the voice coil and the bonding pad. By using the solution of replacing the voice coil lead wires with the two electrically conductive metal layers deposited on the silica gel diaphragm, firstly, the problem of the poor audition caused by the collision of the voice coil lead wires in traditional solutions can be solved, and the acoustic performance of the product can be improved; secondly, the electrically conductive metal layer deposited in the wire groove does not occupy extra space, and avoids the risk of the breakage of the voice coil lead wires vibrated under a large power, so as to improve the product stability; and thirdly, since the electrically conductive metal layer is deposited in the etched wire groove, the conductive layer will not easily drop off and becomes more stable, and compared with techniques such as electroplating or magnetron sputtering, the electrically conductive metal layer obtained via metal deposition is more dense and uniform with a higher conductivity, and any crack will not easily occur.

The above descriptions are just summarizations of the technical solutions of the present disclosure, and in order to understand the technical means of the present disclosure more clearly, the specific embodiments of the present disclosure are given as follows.

BRIEF DESCRIPTION OF DRAWINGS

The drawings are intended to provide a further understanding of the present disclosure, and constitute part of the description. The drawings are intended to interpret the present disclosure along with the embodiments of the present disclosure, and do not function to limit the present disclosure. In the drawings:

FIG. 3-*a* is an enlarged view of a silica gel diaphragm provided by an embodiment of the present disclosure at the section line A as illustrated by FIG. 2 in the state where no wire groove is etched on a surface thereof;

FIG. 3-*b* is an enlarged view of a silica gel diaphragm provided by an embodiment of the present disclosure at the section line A as illustrated by FIG. 2 in the state where a wire groove is etched on a surface thereof;

FIG. 3-*c* is an enlarged view of a silica gel diaphragm provided by an embodiment of the present disclosure at the section line A as illustrated by FIG. 2 when a wire groove is being deposited with a metal conductive material; and FIG. 3-*d* is an enlarged view of a silica gel diaphragm provided by an embodiment of the present disclosure at the section line A as illustrated by FIG. 2 after a wire groove is completely deposited with a metal conductive material.

In the drawings:

1: planar portion; 2: folded ring portion; 3: fixing portion; 4: first soldering portions; 5: second soldering portions; 6: middle portions; 7: electrically conductive metal layer; 8: wire grooves.

DETAILED DESCRIPTION

In order to make the objects, the technical solutions and the advantages of the present disclosure clearer, the embodiments of the present disclosure will be described below in further detail in conjunction with the drawings.

Figure 1:
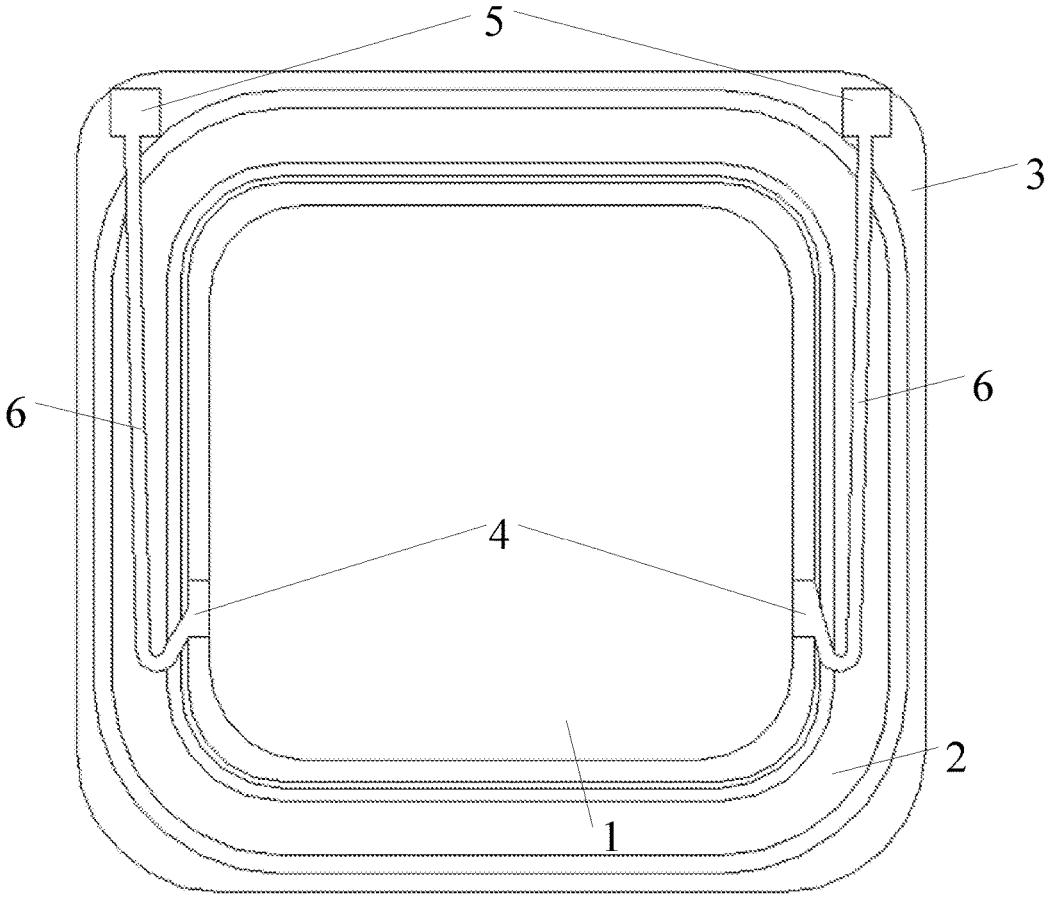
FIG. 1 is a front view of a silica gel diaphragm provided by an embodiment of the present disclosure.
Figure 2:
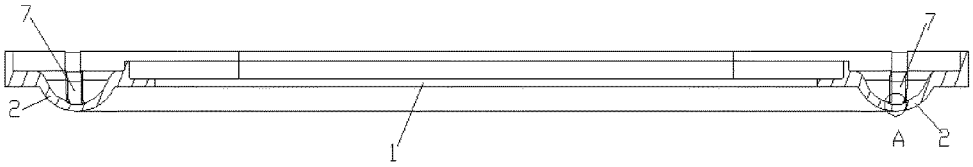
FIG. 2 is a cross-section view of a silica gel diaphragm provided by an embodiment of the present disclosure.

As illustrated by FIGS. 1 and 2 jointly, the embodiment provides a silica gel diaphragm, comprising a planar portion 1 located at a center, a folded ring portion 2 disposed at an edge of the planar portion 1, and a fixing portion 3 connected to the periphery of the folded ring portion 2 for bonding a housing.

The embodiment etches two symmetrical wire grooves on a surface of the silica gel diaphragm by laser etching technique, so as to ensure the balance of the vibrating diaphragm.

In that, an electrically conductive metal layer is deposited in each of the wire grooves, and either end of each of the electrically conductive metal layers is provided with a first soldering portion 4 and a second soldering portion 5, respectively; each of the first soldering portions 4 is deposited on a planar portion 1 of the silica gel diaphragm that is closer to the folded ring portion 2, and is used for soldering a winding tap of a voice coil on an inner side of the voice coil; each of the second soldering portions 5 is deposited on a fixing portion 3 of the silica gel diaphragm, and is used for soldering a bonding pad on the housing; and middle portions 6 connecting the first soldering portions 4 and the second soldering portions 5 are deposited in the silica gel diaphragm to form an electrically conductive path.

FIGS. 3-*a* to 3-*d* jointly illustrate a procedure of depositing the electrically conductive metal layer on the section line A of the silica gel diaphragm provided by the embodiment. In the embodiment, the state of the silica gel diaphragm where no wire groove is etched on a surface thereof is illustrated by FIG. 3-*a*, and the state of the silica gel diaphragm where a wire groove is etched on a surface thereof is illustrated by FIG. 3-*b*. In the embodiment, a metal conductive material is deposited in the wire groove of the silica gel diaphragm by using electrochemical metal deposition method. The procedure of depositing the metal conductive material in the wire groove of the silica gel diaphragm is illustrated by FIG. 3-*c*. An electrically conductive metal layer is obtained after the wire groove of the silica gel diaphragm is completely deposited with the metal conductive material, as illustrated by FIG. 3-*d*. The thickness of the electrically conductive metal layer deposited in FIG. 3-*c* is less than that of the electrically conductive metal layer deposited in FIG. 3-*d*.

To be noted, in order to facilitate the soldering with the bonding pads of the housing, in the embodiment, the second soldering portions of the two electrically conductive metal layers are preferably deposited at the corners of the fixing portion, as illustrated by FIG. 1. Obviously, the second soldering portions in the embodiment include, but not limited to, the above configuration. The positions of the second soldering portions may be specifically set according to the design requirement on the diaphragm, provided that the soldering with the bonding pads of the housing is possible.

In a preferred solution of the embodiment, in order not to influence the inner space of the product, the upper surfaces of the two electrically conductive metal layers are lower than or flush with the surface of the silica gel diaphragm.

In order to further ensure the balance of the diaphragm, in the embodiment, preferably the first soldering portions of the two electrically conductive metal layers are symmetrically deposited at central positions on the planar portion 1 that are closer to the folded ring portion 2.

Of course, in practical applications, the first soldering portions of the two electrically conductive metal layers may also be disposed at other positions on the planar portion. As illustrated by FIG. 1, the first soldering portions 4 of the two electrically conductive metal layers are deposited at positions where the polarization of the diaphragm is minimized. The first soldering portions 4 of the electrically conductive metal layers in the embodiment of the present disclosure include, but not limited to, the above configuration. The positions of the first soldering portions 4 may be specifically set according to the design requirement on the diaphragm, provided that the soldering with the winding tap of the voice coil is possible. In order to improve the acoustic properties of the speaker module and reduce the collision of the voice coil, the embodiment of the present disclosure uses the electrically conductive metal layers deposited on the surface of the silica gel diaphragm to replace the solution of connecting the bonding pads by using the traditional outgoing voice coil lead wires, thereby solving the problem of the collision of the voice coil lead wires, and reducing the noise of the speaker module.

On the other hand, the embodiments of the present disclosure provide a speaker module, comprising a vibration system received in a housing, wherein the vibration system comprises a diaphragm and a voice coil combined together, and the diaphragm is the silica gel diaphragm provided by the above technical solution.

The voice coil is fixed on the inner side of the folded ring portion of the silica gel diaphragm. The first soldering portions of the two electrically conductive metal layers of the silica gel diaphragm are soldered with the winding taps at the two ends of the voice coil, respectively. The second soldering portions of the two electrically conductive metal layers are soldered with the two bonding pads on the housing, respectively.

In practical applications, that the first soldering portions of the two electrically conductive metal layers of the silica gel diaphragm are soldered with the winding taps at the two ends of the voice coil, respectively may be understood as soldering the first soldering portion of one electrically conductive metal layer with the winding tap at one end of the voice coil, and soldering the first soldering portion of the other electrically conductive metal layer with the winding tap at the other end of the voice coil. That the second soldering portions of the two electrically conductive metal layers of the silica gel diaphragm are soldered with the two bonding pads on the housing, respectively may be understood as soldering the second soldering portion of one electrically conductive metal layer with the positive electrode side of the bonding pad, and soldering the second soldering portion of the other electrically conductive metal layer with the negative electrode side of the bonding pad.

In the speaker module of the embodiment, two electrically conductive metal layers deposited in the silica gel diaphragm are used to replace the voice coil lead wires in traditional solutions, such that the first soldering portions of the two electrically conductive metal layers are soldered with the winding taps on the inner side of the voice coil, and the second soldering portions are soldered with the bonding pads on the housing, thereby solving the problem of the poor audition caused by the collision between the voice coil lead wires and the diaphragm or the housing.

Based on the same technical concept as that of the above silica gel diaphragm, the embodiments of the present disclosure further provide a method for reprocessing a silica gel diaphragm, the silica gel diaphragm comprising a planar portion located at a center, a folded ring portion disposed at an edge of the planar portion, and a fixing portion connected to the periphery of the folded ring portion for bonding a housing.

The method for reprocessing a silica gel diaphragm comprises:

etching two symmetrical wire grooves on a surface of the silica gel diaphragm by laser etching technique, so as to ensure the balance of the vibrating diaphragm; and depositing a metal conductive material in the two symmetrical wire grooves to obtain two electrically conductive metal layers;

wherein either end of each of the electrically conductive metal layers is deposited with a first soldering portion and a second soldering portion; each of the first soldering portions is deposited on a planar portion of the silica gel diaphragm that is closer to the folded ring portion, and is used for soldering a winding tap of a voice coil on an inner side of the voice coil; each of the second soldering portions is deposited on a fixing portion of the silica gel diaphragm, and is used for soldering a bonding pad on the housing; and middle portions connecting the first soldering portions and the second soldering portions are deposited in the silica gel diaphragm to form an electrically conductive path. In a preferred solution of the embodiment, in order not to influence the inner space of the product, the upper surfaces of the two electrically conductive metal layers are lower than or flush with the surface of the silica gel diaphragm.

In order to further ensure the balance of the diaphragm, in the embodiment, preferably the first soldering portions of the two electrically conductive metal layers are symmetrically deposited at central positions on the planar portion that are closer to the folded ring portion.

Of course, in practical applications, the first soldering portions of the two electrically conductive metal layers may also be disposed at other positions on the planar portion. For example, the first soldering portions of the two electrically conductive metal layers are deposited at positions where the polarization of the diaphragm is minimized. The first soldering portions of the electrically conductive metal layers in the embodiment include, but not limited to, the above configuration. The positions of the first soldering portions may be specifically set according to the design requirement on the diaphragm, provided that the soldering with the winding tap of the voice coil is possible.

The embodiment etches two symmetrical wire grooves on the surface of the silica gel diaphragm by laser etching technique, and deposits an electrically conductive metal layer in each of the wire grooves by metal deposition technique, such that the soldering portions at the two ends of each of the electrically conductive metal layers can be soldered with the voice coil and the bonding pad, respectively, thereby achieving the connection between the voice coil and the bonding pad.

In conclusion, the embodiments of the present disclosure provide a silica gel diaphragm, a speaker module and a method for reprocessing a silica gel diaphragm. Two symmetrical wire grooves are etched on a surface of the silica gel diaphragm, an electrically conductive metal layer is deposited in each of the wire grooves, and the soldering portions at the two ends of each of the electrically conductive metal layers can be soldered with the voice coil and the bonding pad, respectively, thereby achieving the connection between the voice coil and the bonding pad by using the electrically conductive metal layer. By using the solution of replacing the voice coil lead wires with the two electrically conductive metal layers deposited on the silica gel diaphragm, firstly, the problem of the poor audition caused by the collision of the voice coil lead wires in traditional solutions can be solved, and the acoustic performance of the product can be improved; secondly, the electrically conductive metal layer deposited in the wire groove does not occupy extra space, and avoids the risk of the breakage of the voice coil lead wires vibrated under a large power, so as to improve the product stability; and thirdly, since the electrically conductive metal layer is deposited in the etched wire groove, the conductive layer will not easily drop off and becomes more stable, and compared with techniques such as electroplating or magnetron sputtering, the electrically conductive metal layer obtained via metal deposition is more dense and uniform with a higher conductivity, and any crack will not easily occur.

The above descriptions are merely preferable embodiments of the present disclosure, and are not limiting the protection scope of the present disclosure. Any modifications, equivalent substitutions or improvements that are made within the spirit and principle of the present disclosure are all included in the protection scope of the present disclosure.

What is claimed is:

1. A silica gel diaphragm, comprising a planar portion located at a center, a folded ring portion disposed at an edge of the planar portion, and a fixing portion connected to the periphery of the folded ring portion for bonding a housing, wherein two symmetrical wire grooves are etched on a surface of the silica gel diaphragm by laser etching technique; and an electrically conductive metal layer is deposited in each of the wire grooves, and either end of each of the electrically conductive metal layers is provided with a first soldering portion and a second soldering portion; each of the first soldering portions is deposited on a planar portion of the silica gel diaphragm in an area that is closer to the folded ring portion than the second soldering portions, and is used for soldering a winding tap of a voice coil on an inner side of the voice coil; each of the second soldering portions is deposited on the fixing portion of the silica gel diaphragm, and is used for soldering a bonding pad on the housing; and middle portions connecting the first soldering portions and the second soldering portions are deposited in the silica gel diaphragm to form an electrically conductive path.

2. The silica gel diaphragm according to claim 1, wherein upper surfaces of the two electrically conductive metal layers are lower than or flush with the surface of the silica gel diaphragm.

3. The silica gel diaphragm according to claim 1, wherein the first soldering portions of the two electrically conductive metal layers are symmetrically deposited at central positions on the planar portion that are closer to the folded ring portion.

4. A speaker module, comprising a vibration system received in a housing, wherein the vibration system comprises a silica gel diaphragm and a voice coil combined together, wherein the silica gel diaphragm comprising a planar portion located at a center, a folded ring portion disposed at an edge of the planar portion, and a fixing portion connected to the periphery of the folded ring portion for bonding a housing, wherein two symmetrical wire grooves are etched on a surface of the silica gel diaphragm by a laser etching technique; and an electrically conductive metal layer is deposited in each of the wire grooves, and either end of each of the electrically conductive metal layers is provided with a first soldering portion and a second soldering portion; each of the first soldering portions is deposited on a planar portion of the silica gel diaphragm in an area that is closer to the folded ring portion than the second soldering portions, and is used for soldering a winding tap of a voice coil on an inner side of the voice coil; each of the second soldering portions is deposited on the fixing portion of the silica gel diaphragm, and is used for soldering a bonding pad on the housing; and middle portions connecting the first soldering portions and the second soldering portions are deposited in the silica gel diaphragm to form an electrically conductive path; and the voice coil is fixed on an inner side of the folded ring portion of the silica gel diaphragm; first soldering portions of two electrically conductive metal layers of the silica gel diaphragm are soldered with winding taps at two ends of the voice coil, respectively; and second soldering portions of the two electrically conductive metal layers are soldered with two bonding pads on the housing, respectively.

5. A method for reprocessing a silica gel diaphragm, the silica gel diaphragm comprising a planar portion located at a center, a folded ring portion disposed at an edge of the planar portion, and a fixing portion connected to the periphery of the folded ring portion for bonding a housing, wherein the method comprises:

etching two symmetrical wire grooves on a surface of the silica gel diaphragm by laser etching technique; and depositing a metal conductive material in the two symmetrical wire grooves to obtain two electrically conductive metal layers;

wherein either end of each of the electrically conductive metal layers is deposited with a first soldering portion and a second soldering portion; each of the first soldering portions is deposited on a planar portion of the silica gel diaphragm in an area that is closer to the folded ring portion than the second soldering portions, and is used for soldering a winding tap of a voice coil on an inner side of the voice coil; each of the second soldering portions is deposited on the fixing portion of the silica gel diaphragm, and is used for soldering a bonding pad on the housing; and middle portions connecting the first soldering portions and the second soldering portions are deposited in the silica gel diaphragm to form an electrically conductive path.

6. The method according to claim 5, wherein the depositing a metal conductive material in the two symmetrical wire grooves to obtain two electrically conductive metal layers comprises:

upper surfaces of the two electrically conductive metal layers are lower than or flush with the surface of the silica gel diaphragm.

7. The method according to claim 5, wherein each of the first soldering portions is deposited on a planar portion of the silica gel diaphragm that is closer to the folded ring portion comprises:

the first soldering portions of the two electrically conductive metal layers are symmetrically deposited at central positions on the planar portion that are closer to the folded ring portion.

8. The speaker module according to claim 4, wherein upper surfaces of the two electrically conductive metal layers are lower than or flush with the surface of the silica gel diaphragm.

9. The speaker module according to claim 4, wherein the first soldering portions of the two electrically conductive metal layers are symmetrically deposited at central positions on the planar portion that are closer to the folded ring portion.

* * * * *